US012790750B2

(12) United States Patent
Gloning et al.

(10) Patent No.: US 12,790,750 B2
(45) Date of Patent: Nov. 10, 2026

(54) METHOD AND MACHINE FOR PRODUCING A FIBROUS WEB

(71) Applicant: Voith Patent GmbH, Heidenheim (DE)

(72) Inventors: Alexander Gloning, Zöbingen (DE); Christin Brück, Giengen (DE); Jonas Bergström, Ulm (DE); Matthias Höhsl, Heidenhim (DE)

(73) Assignee: Voith Patent GmbH, Heidenheim (DE)

( * ) Notice: Subject to any disclaimer, the term of this patent is extended or adjusted under 35 U.S.C. 154(b) by 272 days.

(21) Appl. No.: 18/405,613

(22) Filed: Jan. 5, 2024

(65) Prior Publication Data

US 2024/0141590 A1 May 2, 2024

Related U.S. Application Data

(63) Continuation of application No. PCT/EP2022/068508, filed on Jul. 5, 2022.

(30) Foreign Application Priority Data

Jul. 8, 2021 (DE) ..... 10 2021 117 647.6

(51) Int. Cl.
*D21F 11/00* (2006.01)
*D04H 1/44* (2006.01)
(Continued)

(52) U.S. Cl.
CPC ..... *D21F 11/006* (2013.01); *D04H 1/44* (2013.01); *D04H 1/70* (2013.01); *D21F 9/00* (2013.01); *D21H 27/002* (2013.01); *D21H 27/02* (2013.01)

(58) Field of Classification Search
CPC . D21F 11/006; D21F 9/00; D21F 3/00; D21F 11/00; D21H 27/002; D21H 27/02;
(Continued)

(56) References Cited

U.S. PATENT DOCUMENTS 3,301,746 A 1/1967 Sanford et al.
5,522,312 A * 6/1996 Johnson ..... D21G 1/0093 100/162 R
(Continued)

FOREIGN PATENT DOCUMENTS

CA 2309998 C * 10/2007 ..... D04H 1/54
CN 1282233 A 1/2001
(Continued)

OTHER PUBLICATIONS

German Office Action dated May 23, 2022 for German Patent Application No. 10 2021 117 647.6 (10 pages).
(Continued)

*Primary Examiner* — Jose A Fortuna
(74) *Attorney, Agent, or Firm* — TAYLOR & EDELSTEIN, PC

(57) ABSTRACT

A method for producing a web of fibrous material, the method including the steps of: forming the web by a dry-laying process; pressing and consolidating the web in a press nip while the web lies between a first support element and a second support element, a contact surface of the first support element and a contact surface of the second support element respectively facing the web; forming at least one low-pressure zone and at least one high-pressure zone in the web by way of the contact surface of the first support element; and exerting upon the web in the at least one high-pressure zone a pressure of more than 10 MPa.

19 Claims, 5 Drawing Sheets

(51) Int. Cl.

| | |
|---|---|
| ***D04H 1/70*** | (2012.01) |
| ***D21F 9/00*** | (2006.01) |
| ***D21H 27/00*** | (2006.01) |
| ***D21H 27/02*** | (2006.01) |

(58) Field of Classification Search
CPC ..... D21H 27/40; D21H 5/26; D04H 1/44; D04H 1/70; D04H 17/00
See application file for complete search history.

(56) References Cited

U.S. PATENT DOCUMENTS

| | | | | |
|---|---|---|---|---|
| 5,652,041 | A * | 7/1997 | Buerger | B32B 5/26 156/308.2 |
| 5,709,775 | A | 1/1998 | Trokhan et al. | |
| 5,836,242 | A * | 11/1998 | Aberg | D21G 1/0066 100/327 |
| 6,042,695 | A * | 3/2000 | Ishino | D21F 3/0227 162/358.4 |
| 6,090,241 | A * | 7/2000 | Trokhan | D21F 11/006 162/207 |
| 6,397,739 | B1 * | 6/2002 | Viljanmaa | D21G 1/0233 100/153 |
| 6,554,963 | B1 * | 4/2003 | Botelho | D21F 11/006 28/100 |
| 6,675,702 | B1 * | 1/2004 | Maksimow | D04H 1/44 100/41 |
| 6,701,637 | B2 * | 3/2004 | Lindsay | D21F 5/004 162/207 |
| 6,712,930 | B2 * | 3/2004 | Koivukunnas | D21G 1/006 162/111 |
| 6,780,287 | B2 * | 8/2004 | Sakuma | D21G 1/0066 162/358.4 |
| 6,998,017 | B2 * | 2/2006 | Lindsay | D21F 11/006 162/111 |
| 7,000,536 | B2 * | 2/2006 | Laitila | D21G 1/0066 100/153 |
| 8,597,469 | B2 * | 12/2013 | Biagiotti | D21F 11/14 162/362 |
| 8,789,289 | B2 * | 7/2014 | Herman | F26B 13/28 34/399 |
| 10,182,948 | B2 * | 1/2019 | Li | A61F 13/536 |
| 11,999,118 | B2 * | 6/2024 | D'Hondt | B29C 70/504 |
| 2005/0167061 | A1 | 8/2005 | Scherb et al. | |
| 2011/0272112 | A1 | 11/2011 | Aberg et al. | |
| 2011/0303379 | A1 * | 12/2011 | Boechat | D21F 11/006 162/358.3 |
| 2016/0332325 | A1 | 11/2016 | Murayama et al. | |
| 2017/0226698 | A1 * | 8/2017 | LeBrun | B32B 7/12 |
| 2021/0131035 | A1 | 5/2021 | Burazin et al. | |
| 2024/0141590 | A1 * | 5/2024 | Gloning | D21H 27/02 |

FOREIGN PATENT DOCUMENTS

| | | | | |
|---|---|---|---|---|
| CN | 117616169 | A * | 2/2024 | D21F 11/006 |
| KR | 101750039 | B1 * | 6/2017 | D21F 1/0027 |
| WO | WO-9925281 | A1 * | 5/1999 | D04H 1/44 |
| WO | 2009/067079 | A1 | 5/2009 | |
| WO | 2016/066375 | A1 | 5/2016 | |
| WO | WO-2023280806 | A1 * | 1/2023 | D21F 11/006 |
| WO | WO-2025228807 | A1 * | 11/2025 | D21H 25/005 |
| WO | WO-2026012674 | A1 * | 1/2026 | D21F 11/02 |

OTHER PUBLICATIONS

Notification of the Transmission of the International Search Report and Written Opinion of the International Search Authority or Declaration dated Oct. 31, 2022 for International Application No. PCT/EP2022/068508 (16 pages).

* cited by examiner

METHOD AND MACHINE FOR PRODUCING A FIBROUS WEB

CROSS REFERENCE TO RELATED APPLICATIONS

This is a continuation of PCT application no. PCT/EP2022/068508, entitled "METHOD AND MACHINE FOR PRODUCING A FIBROUS WEB", filed Jul. 5, 2022, which is incorporated herein by reference. PCT application no. PCT/EP2022/068508 claims priority to German patent application no. 10 2021 117 647.6, filed Jul. 8, 2021, which is incorporated herein by reference.

BACKGROUND OF THE INVENTION

1. Field of the Invention

The present invention relates to producing a fibrous web, and, more particularly, to producing a fibrous web using a dry laying method.

2. Description of the Related Art

In the production of fibrous webs using the wet laying process, especially in the production of tissue webs or nonwoven webs, strength-enhancing agents are often used.

The wet laying method is the most commonly used process for producing a fibrous web, such as a tissue web and a nonwoven web. At the beginning of the manufacturing process, the solids of these fibrous webs are suspended in water and are fed via the headbox to a forming section in a paper machine, where they are mechanically dewatered and subsequently thermally dried in a drying section. Due to the presence of water, so-called hydrogen bonds are formed, which lead to a basic strength in the fibrous web. To further increase this basic strength, strength-enhancing agents are added to the fibrous web.

In an effort to optimize the manufacturing processes for fibrous webs with regard to reducing energy consumption and $CO_2$ emissions, more and more dry-laying processes are being used. By dispensing with water in the delivery of the fibers for the production of a fibrous web, enormous amounts of energy and $CO_2$ emissions can be saved compared to wet-laid papers by eliminating the thermal drying step. However, in these processes, the strength of the fibrous webs can no longer be sufficiently achieved by the formation of hydrogen bonds, since little or no water is used, and the fibers therefore are almost dry-laid to form the web. During production of tissue webs and nonwovens, latex polymers are sprayed onto the paper surface, or synthetic fusible fibers are added to the fibers before dry-laying. The fibrous web with fusible fibers is subsequently heated. The fusible fibers melt and bond with the cellulose fibers of the fibrous web, thereby increasing or creating the consolidation in the fibrous web. These strength-enhancing agents are also expensive and account for a significant part of the production costs of these papers. In addition, latex polymers and fusible fibers have poor or even no biodegradability.

What is needed in the art is a method and a machine for achieving a cost-effective and ecological increase in strength in the production of fibrous webs, such as tissue webs and nonwoven webs, and to reduce or even completely avoid the disadvantages of the known methods.

SUMMARY OF THE INVENTION

The present invention relates to a method for producing a fibrous web, in particular a tissue web or a nonwoven web, which is formed by way of a dry-laying method. The present invention also relates to a machine to carry out said method, and to a fibrous web having improved strength. The present invention provides a method for producing a fibrous web, in particular a tissue web or a nonwoven web, which is formed by a dry-laying process and wherein the fibrous web is pressed and consolidated in a pressing step in a press nip while lying between a first and a second supporting element, whose contact surface respectively is facing the fibrous web, wherein the contact surface of at least the first supporting element is designed in such a way that at least one low-pressure zone and at least one high-pressure zone are formed in the fibrous web, and a pressure of more than 10 MPa, in particular more than 15 MPa, in particular more than 25 MPa, is exerted on the fibrous web in the at least one high-pressure zone.

By way of the contact surface of the first support element, a three-dimensional structure is embossed into the fibrous web in the press nip. As a result of the present invention, the strength, for example the tensile strength, is increased without jeopardizing the necessary characteristics of the fibrous web, for example thickness, water absorption capacity, softness, specific volume.

Due to strong local pressing of the fibrous web in the at least one high-pressure zone, the fibrous web is compacted there and thus differentiates itself from the at least one low-pressure zone. The sum of the area of all low-pressure zones and the at least one high-pressure zone of a test area of the fibrous web are consistent with the total area and thus correspond with the test area. The area shares of the at least one high-pressure zone can thus be easily determined.

It can also be advantageous if several press nips or pressing steps, optionally two press nips, optionally three press nips, are arranged one after the other. This can advantageously result in further improvement of the parameters, at only slightly higher investment costs. Between the respective press nips or before or after the respective press nips, other components, for example an application device for a wet strengthening agent or another strength-enhancing agent to further increase the strength, may be arranged. Moreover, the alternative embodiments of press nips shown in the diagram description can be combined with each other in different ways. An arrangement according to FIG. 2 or FIG. 3 in the first press nip, and an arrangement according to FIG. 5 in a second or third press nip is for example conceivable.

New developments in the manufacturing process for fibrous webs are moving towards dry-laying methods with a view to reducing energy consumption and $CO_2$ emissions. In these processes, the fibers are separated in an almost dry, usually air-dry state and are fed to a dry-laying device to form the fibrous web. The necessary strength of the thus produced fibrous web can no longer be sufficiently achieved by the formation of hydrogen bonds, since no water or only small amounts of water are used, and the fibers are therefore laid in an almost dry state to form the web. Here, the present invention has a particularly positive effect, especially in the production of tissue webs and nonwovens webs. On the one hand, sufficient strength must be achieved with these types of paper, especially during the dry-laying process, and on the other hand, the requirements with regard to use, such as specific volume, water absorption, water retention capacity, suppleness—also referred to as 'handfeel'—must be met. Thus, according to the present invention, a pressure of more than 10 MPa, in particular more than 15 MPa, is exerted upon the fibrous web in a high-pressure zone in order to achieve not only strength but also to meet the requirements for use of the fibrous web.

For these reasons, the present invention can be used particularly advantageously for hygienic paper. Hygienic paper can include tissue webs and nonwoven webs. They may include products from the exemplary, however incomplete list of the following group: wipes, towels, napkins, tablecloths, etc.

The present invention may also be advantageous in the production of nonwovens, as they can at least in part include plastic fibers that do not form hydrogen bonds.

It is therefore also advantageous if the tissue webs or nonwoven webs that are to be produced are designed to have a basis weight of 10 $g/m^2$ to 50 $g/m^2$, optionally 12 $g/m^2$ to 45 $g/m^2$.

It is therefore also advantageous if the at least one high-pressure zone is formed having an area of less than 9 $mm^2$, optionally less than 4 $mm^2$, and optionally more than 0.5 $mm^2$. On the one hand, sufficient strength is produced and, on the other hand, the requirements in regard to use, such as specific volume, water absorption, water retention capacity, softness—also known as "handfeel"—are met.

In an advantageous design, it is possible that at least one high-pressure zone is formed having an area in the range of 0.5 $mm^2$ to 2 $mm^2$.

It is also advantageous if the at least one high-pressure zone has an area share of 5% to 60% of the pressed area, optionally 5% to 20%, optionally 5% to 30%, optionally 30% to 60%, optionally 35% to 50%.

In a possible design, several high-pressure zones can be formed. In this case, the sum of the areas of the high-pressure zones has an area share of 5% to 60% of the pressed area, optionally 5% to 30%, optionally 30% to 60%, optionally 35% to 50%.

In a practical situation, several high-pressure zones can be formed and a distance of less than the average fiber length of the fibers in the fibrous web can be arranged between adjacent high-pressure zones.

Moreover, it is also conceivable to connect the at least one high-pressure zone with adjacent high-pressure zones by way of a respective additional high-pressure zone. The additional high-pressure zone can progress in a linear manner Starting from one high-pressure zone, the additional high-pressure zones progress radially. This increases the strength of the fibrous web while maintaining a good specific volume.

In the possible event that several high-pressure zones are formed, a pressure of more than 10 MPa, optionally more than 15 MPa, optionally more than 25 MPa, is exerted upon the fibrous web in each high-pressure zone.

The pressure in the high-pressure zones can be as high as 70 MPa, optionally as high as 50 MPa, for particularly high strengths or if the tissue or nonwovens webs contain certain types of fibers.

In the at least one low-pressure zone, a pressure of less than 10 MPa, optionally less than 8 MPa, optionally greater than 0 MPa, or in the range of greater than 0 to 3 MPa, can be exerted on the fibrous web. Optionally, the at least one low-pressure zone is only lightly pressed, so that the pressure is slightly greater than 0 MPa, optionally greater than 0.1 MPa, optionally greater than 1 MPa.

Advantageously, the flat fibrous web is also pre-compressed or pressed in the low-pressure zone, in particular to a value of less than 50%, optionally less than 80%, of the original specific volume of the fibrous web from the dry-laying process. Or in other words: the compression or pressing is carried out in such a way that the thickness of the laid fibrous web immediately after the at least one pressing step is a maximum of 50%, optionally a maximum of 80% of the thickness of the fibrous web laid in a dry-laying process before the pressing step. This improves the stability of the laid fibrous web. This applies especially in continuous production of the fibrous web. As a result, the fibrous web becomes insensitive to air currents.

A dry-laid fibrous web is usually characterized in that the fibrous web is laid with a specific volume of more than 12 $cm^3/g$, optionally more than 20 $cm^3/g$, optionally more than 25 $cm^3/g$, is laid. On the one hand, this has a positive effect on the homogeneous distribution of the individual fibers and/or fiber bundles in the volume of the fibrous web and, on the other hand, on the effect and uniformity of the distribution of the applied water. As a result, a fibrous web having homogeneous strength distribution can be achieved with the use of a minimum amount of water. Or in other words: the thickness of the fibrous web before the pressing step is more than 2 mm, optionally more than 5 mm, optionally more than 10 mm.

In an advantageous design, the dry-laying method is carried out before at least one pressing step in such a way that the fibrous web has a dry content greater than 50%, in particular greater than 70%, optionally greater than 80%, optionally greater than 90%, before at least one pressing step. Usually, a dry-laid fibrous web has a very high dry content, as no, or only small, amounts of water are added to the stock preparation.

If, in an alternative embodiment, wet-strength agents or another strength-enhancing agent, such as water, is added before the pressing step, the dry content can be influenced, for example, by heating the fibrous web during the pressing step.

The first support element and/or the second support element may be designed as a roll having a contact surface with or without protrusions to produce the at least one high-pressure zone. The role can be designed either as a roll that has optionally a metallic or coated surface, or as a shoe roll or as a roll with a roll cover made of plastic.

In the case of the roll that has optionally a metallic or coated surface, the roll surface represents directly the contact surface. A roll with an optionally metallic or coated surface is therein harder than a roll with a roll cover made of plastic.

In the case of the shoe roll, the press shell represents the contact surface.

In the case of a roll with a plastic roll cover, the roll cover provides the contact surface.

The contact surface may herein be designed having protrusions.

For example, a combination of a first support element, which is designed as a roll whose surface directly forms the contact surface, and a second support element, which is designed as a roll with a roll cover made of plastic, a soft surface, is conceivable. This results in a so-called "soft-nip" press nip.

For example, the contact surface of the first support element, optionally the metallic or coated surface of the roll, can be made with protrusions.

As an additional alternative, the roll cover can be made of plastic with protrusions. The roll cover with protrusions provides herein the contact surface of the support element.

In the case of a roll where the surface of the roll represents the contact surface directly, the surface can be made with protrusions for example in a machining process using EDM or milling.

In another alternative embodiment, the second support element is designed as a roll having optionally a metallic or coated surface and having a smooth surface, in other words, without protrusions.

In another conceivable combination, a first support element is designed as a roll having optionally a metallic or coated surface and protrusions, and the second support element is designed as a roll having optionally a metallic or coated surface and having a smooth surface. Such a combination of a press roll, wherein the contact surface is designed directly with the surface of a roll as the first support element and a mating roll, wherein the contact surface is designed directly with the surface of a roll as the second support element, is a "hard-nip" press nip.

In an alternative embodiment, the first support element and/or the second support element is designed as a roll and optionally the first support element and/or the second support element is designed with protrusions to structure the fibrous web.

The first support element and/or the second support element can be designed as a revolving belt with protrusions to create several high-pressure zones.

The revolving belt can be designed as a membrane or as a woven belt, for example as a screen, with protrusions applied to the contact side. The protrusions can be plastic and printed.

The revolving belt may be designed as a woven belt, wherein the protrusions can be formed by weaving threads.

The first support element and/or the second support element can be designed to be permeable or impermeable.

In the loop formed by the first support element that is designed as a belt and/or in the loop formed by the second support element that is designed as a belt, a roll may be arranged to form the press nip. The press nip can be formed by a press roll and a mating roll. The press roll can also be designed as a shoe press roll with an extended press nip. The press nip can also be formed by calender rolls.

In one possible design, at least one high-pressure zone can be created by protrusions in the contact surface of the at least first support element. The cross-sectional shape of the protrusions can be round, triangular, square or elongated, so the shape of the high-pressure zones can be correspondingly round, triangular, square or elongated. The shapes of the high-pressure zones can also be different.

The protrusions can optionally be designed having a height of 0.05 mm to 1 mm, optionally 0.05 mm to 0.5 mm. This allows pressing in the at least one high-pressure zone and in the at least one low-pressure zone to be adjusted relative to each other.

In a possible further development, the at least first support element can be designed as a perforated membrane, and the at least one high-pressure zone can be created by the contact surface of the membrane and the low-pressure zones by the surface of the perforations of the at least first support element. This embodiment differs in that each opening respectively creates a low-pressure zone and in that only one high-pressure zone is created in between.

To improve the increase in strength, the at least one high-pressure zone can be heated to a temperature, optionally a surface temperature of the rolls, from 50° C. to 250° C., in particular optionally from 110° C. to 160° C.

In a possible further development, the contact surface of at least the first support element can be designed in such a way that several high-pressure zones are created and the layout of the high-pressure zones contributes in creating an aesthetic effect in patterns.

In another possible arrangement, the contact surface of the at least first support element can be designed in such a way that several high-pressure zones are created, and the configuration of the high-pressure zones is selected in such a way that the tensile strength in the plane of the fibrous web is direction-dependent. For example, tensile strength can be increased in one direction by providing more high-pressure zones per unit length in that direction than in another direction. Thus, in this particular direction, there is a higher density of high-pressure zones.

It is also conceivable that by adjusting the high-pressure zone density and/or the high-pressure zone configuration, the paper properties, for example the strength properties, can be designed directionally oriented.

In one possible design, the second support element opposite the at least first support element is designed to be flexible in order to structure the side of the fibrous web that comes into contact with the second support element. This also structures the reverse side of the fibrous web, thereby supporting and enhancing the compliance with requirements regarding use, such as specific volume, water absorption, water retention capacity and suppleness, also known as handfeel.

In some cases, it may be advantageous to add a wet strength agent or other strength-enhancing agent to the fibrous web before and/or after the pressing step to further increase the strength.

It is also possible that the fibrous web is creped after the pressing step.

With dry-laid fibrous webs it is also advantageous if the fibrous web is slightly pre-pressed prior to entering the press nip in order to render the laid, loose fibrous mat resistant to air currents.

The present invention also provides a machine for implementation of the method according to the method described above for producing a fibrous web, in particular a tissue web or a nonwoven web. The machine includes a dry-laying section and a press nip in which the fibrous web is pressed and consolidated while lying between a first and a second support element, each of which has a contact surface facing the fibrous web, wherein the contact surface of at least the first support element is designed so that at least one low-pressure zone and at least one high-pressure zone are formed in the fibrous web and wherein, in the at least one high-pressure zone, a pressure of more than 10 MPa, optionally more than 15 MPa, optionally more than 25 MPa, is exerted on the fibrous web.

The present invention also relates to a fibrous web which is formed by the method according to the method described above in a dry-laying process, including at least one low-pressure zone and at least one high-pressure zone, wherein in the at least one high-pressure zone a pressure of more than 10 MPa, optionally more than 15 MPa, optionally more than 25 MPa, is exerted on the fibrous web.

The present invention also extends expressly to embodiments which are not addressed by combinations of features in explicit references to the claims, whereby the disclosed features of the present invention can be arbitrarily combined with each other—provided this is technically practical.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiment of the invention, and such exemplifications are not to be construed as limiting the scope of the invention in any manner.

DETAILED DESCRIPTION OF THE INVENTION

Figure 1:
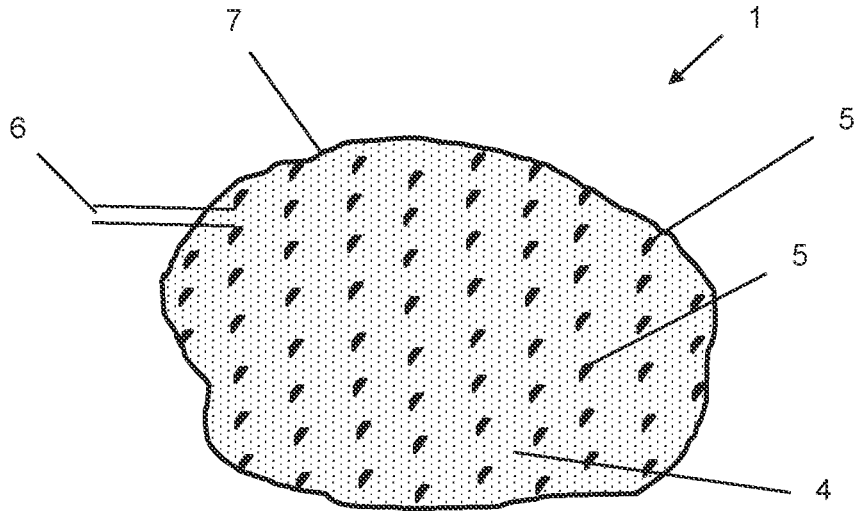
FIG. 1 a possible embodiment of a fibrous web according to the present invention in simplified and schematic representation.

FIG. 1 shows a top view as of a section in a simplified and schematic representation of a possible embodiment of a fibrous web according to the present invention. In this example, fibrous web 1 has a multitude of high-pressure zones 5. High-pressure zones 5 were heavily pressed during the manufacturing process in order to produce greater strength. The local pressure in high-pressure zones 5 was more than 10 MPa. The area between high-pressure zones 5 has been lightly pressed and forms a single low-pressure zone 4. Compression in low-pressure zone 4 was in the range of greater than 0 MPa to 1 MPa. High-pressure zones 5 are trapezoidal. However, they can be of any shape, for example round, triangular, square, etc. High-pressure zones 5 in pressed surface 7 are evenly distributed. However, they can also be arranged in patterns to make the appearance of fibrous web 1 more attractive. This is advantageous for tissue webs and nonwoven webs. Distance 6 of adjacent high-pressure zones 5 is optionally smaller than the average fiber length of fibrous web 1. The dimensions of individual high-pressure zones 5 are each smaller than 9 $mm^2$ and have a surface share of the pressed area of 5% to 50%. The dimensions of each high-pressure zone 5 can be the same or different.

Figure 2:
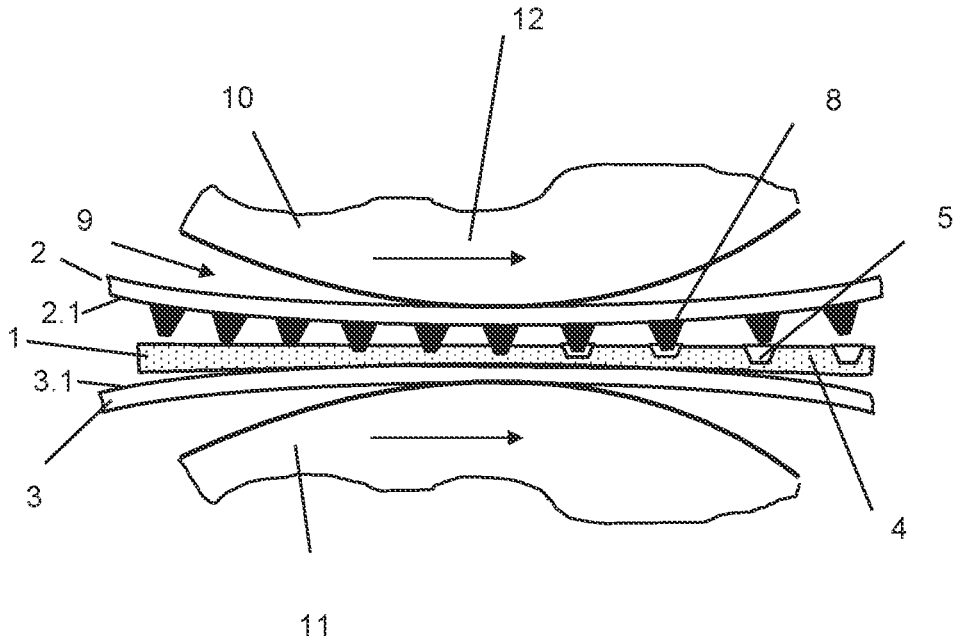
FIG. 2 a possible embodiment of the press nip in the press section of the machine according to the present invention in a simplified representation which is not to scale, wherein both support elements are designed as a belt or as a roll with a roll cover.

FIG. 2 shows a possible embodiment of press nip 9 of the press section of the machine according to the present invention in a simplified representation which is not to scale. Fibrous web 1 is guided while lying between a first support element 2 and a second support element 3 through a press nip 9 in the direction of travel 12. First support element 2 and second support element 3 are formed by a revolving belt. Press nip 9 includes a press roll 10 arranged in the loop of the first support element and a mating roll 11 arranged in the loop of the second support element. In order to produce high-pressure zones 5, first support element 2 has protrusions 8 in the contact surface facing toward fibrous web 1. As it passes through press nip 9, protrusions 8 exert strong local pressure on fibrous web 1, causing it to consolidate. After press nip 9, the protrusions separate again from fibrous web 1, resulting in a structured three-dimensional surface structure with high-pressure zones 5 and—in this example—a single low-pressure zone 4.

Figure 3:
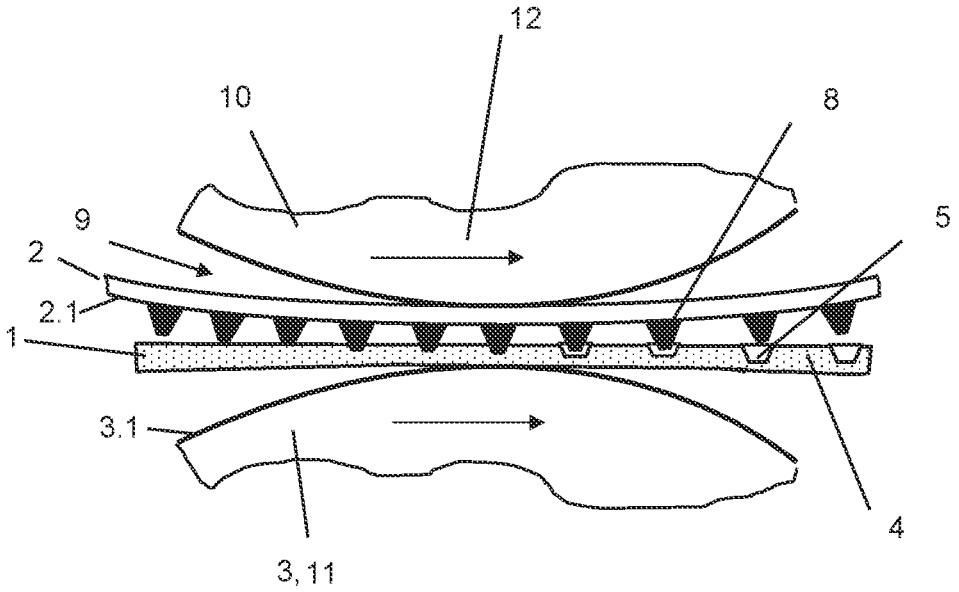
FIG. 3 a possible embodiment of the press nip in the press section of the machine according to the present invention in a simplified representation which is not to scale, wherein a support element is designed as a roll, the surface of which is smooth and directly forms the contact surface.

FIG. 3 shows an alternative possible embodiment of press nip 9 of the press section of the machine according to the present invention in a simplified representation which is not to scale. Fibrous web 1 is guided between a first support element 2 and a second support element 3 through a press nip 9 in the direction of travel 12. Press nip 9 includes a press roll 10 and a mating roll 11.

Press roll 10 can be located in the loop of the first support element, wherein first support element 2 is formed by a revolving belt or a roll cover of press roll 10.

Mating roll 11—optionally with a metallic or coated and smooth surface—provides second support element 3 and second contact surface 3.1. First support element 2 has protrusions 8 in the contact surface facing fibrous web 1 for formation of high-pressure zones 5. Fibrous web 1 is strongly pressed locally by the protrusions 8 as it passes through press nip 9 and thus consolidated. After press nip 9, protrusions 8 separate from fibrous web 1, creating a structured three-dimensional surface structure with high-pressure zones 5 and—in this example—a single low-pressure zone 4.

Figure 4:
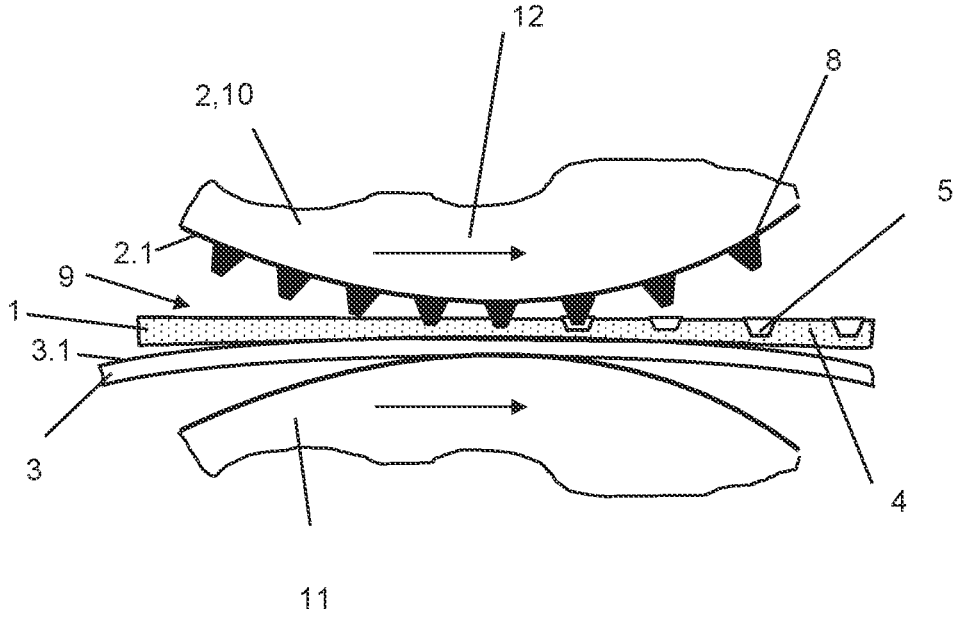
FIG. 4 a possible embodiment of the press nip in the press section of the machine according to the present invention in a simplified representation which is not to scale, wherein a support element is designed as a roll, the surface of which has protrusions and directly forms the contact surface.

FIG. 4 shows an alternative possible embodiment of press nip 9 of the press section of the inventive machine in a simplified representation which is not to scale. Fibrous web 1 is guided while lying between a first support element 2 and a second support element 3 through a press nip 9 in direction of travel 12. Press nip 9 includes a press roll 10 and a mating roll 11.

Mating roll 11 can be arranged in the loop of the second support element, wherein second support element 3 is formed by a revolving belt or a roll cover of mating roll 11.

Press roll 10—optionally with a metallic or coated surface with protrusions—forms first support element 2 and first contact surface 2.1. First support element 2 or press roll 10 has protrusions 8 on contact surface 2.1 facing the fibrous web 1 to create high pressure zones 5. Fibrous web 1 is strongly pressed locally by protrusions 8 as it passes through press nip 9 and is thus consolidated. After press nip 9, protrusions 8 separate from fibrous web 1, creating a structured three-dimensional surface structure with high-pressure zones 5 and, in this example, a single low-pressure zone 4.

Figure 5:
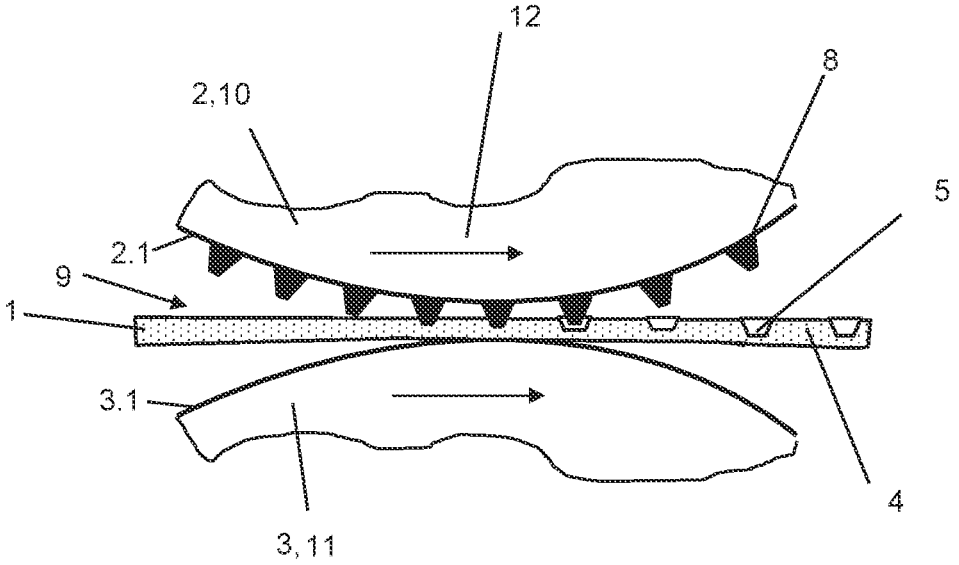
FIG. 5 a possible embodiment of the press nip in the press section of the machine according to the present invention in a simplified representation which is not to scale, wherein both support elements are designed as rolls, the surface of which directly forms the contact surface.

FIG. 5 shows an alternative possible embodiment of press nip 9 of the press section of the inventive machine in a simplified representation which is not to scale. Fibrous web 1 is guided while lying between a first support element 2 and a second support element 3 through a press nip 9 in direction of travel 12. Press nip 9 includes a press roll 10 and a mating roll 11.

Mating roll 11—optionally with a metallic or coated and smooth surface—forms second support element 3 and second contact surface 3.1.

Press roll 10—optionally with a metallic or coated surface with protrusions—forms first support element 2 and first contact surface 2.1. First support element 2 or press roll 10 has protrusions 8 on contact surface 2.1 facing the fibrous web 1 to create high pressure zones 5. Fibrous web 1 is strongly pressed locally by protrusions 8 as it passes through press nip 9 and is thus consolidated. After press nip 9, protrusions 8 separate from fibrous web 1, creating a structured three-dimensional surface structure with high-pressure zones 5 and, in this example, a single low-pressure zone 4.

Corresponding elements of the embodiments shown in the drawings are identified with the same reference numbers. The functions of such elements in the individual drawings correspond to each other, unless otherwise described and it does not lead to contradictions. A repeated description is therefore dispensed with.

IDENTIFICATION LISTING

1 Fibrous web, tissue web, nonwoven web
2 First support element
3 Second support element
3.1 Contact surface
4 Low-pressure zone
5 High-pressure zone
6 Distance—high pressure zones
7 Presses surface
8 Protrusions
9 Press nip
10 Press roll
11 Mating roll
12 Direction of travel While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for producing a web of fibrous material, the method comprising the steps of:
forming the web by a dry-laying process;
pressing and consolidating the web in a press nip while the web lies between a first support element and a second support element, a contact surface of the first support element and a contact surface of the second support element respectively facing the web, the contact surface of the second support element being smooth;
forming at least one low-pressure zone and at least one high-pressure zone in the web by way of the contact surface of the first support element; and
exerting upon the web in the at least one high-pressure zone a pressure of more than 10 MPa.

2. The method according to claim 1, wherein the at least one high-pressure zone is formed with an area of less than 9 $mm^2$.

3. The method according to claim 1, wherein the at least one high-pressure zone is formed with an area of less than 9 $mm^2$ and more than 0.5 $mm^2$.

4. The method according to claim 1, wherein a plurality of the at least one high-pressure zone are formed, the plurality of the at least one high-pressure zone being a plurality of high-pressure zones, a distance of less than an average fiber length of a plurality of fibers of the web being formed between adjacent ones of the plurality of high-pressure zones.

5. The method according to claim 1, wherein the at least one high-pressure zone is connected with an adjacent high-pressure zone by way of an additional high-pressure zone.

6. The method according to claim 1, wherein the at least one high-pressure zone has an area share of 5% to 60% of a pressed area.

7. The method according to claim 1, wherein the at least one high-pressure zone has an area share of 5% to 30% of a pressed area.

8. The method according to claim 1, wherein, in the at least one low-pressure zone, a pressure of less than 10 MPa is exerted on the web.

9. The method according to claim 1, wherein a plurality of the at least one high-pressure zone are created by a plurality of protrusions in the contact surface of at least the first support element.

10. The method according to claim 9, wherein the plurality of protrusions have a height of 0.05 mm to 1 mm.

11. The method according to claim 1, wherein at least the first support element is formed as a perforated membrane, the at least one high-pressure zone is created by the contact surface of the perforated membrane, the at least one low-pressure zone is created by the surface of the perforations of at least the first support element.

12. The method according to claim 1, wherein the contact surface of the first support element is formed such that a plurality of the at least one high-pressure zone are produced, and a configuration of the plurality of the at least one high-pressure zone in a plurality of patterns contributes to creating an aesthetic effect.

13. The method according to claim 1, wherein second support element is located opposite the first support element and is flexible so as to structure a side of the web that comes into contact with second support element.

14. The method according to claim 1, wherein at least one of the first support element and the second support element is formed as a roll.

15. The method according to claim 14, wherein at least one of the first support element and the second support element is configured for structuring the web with a plurality of protrusions.

16. The method according to claim 1, wherein a wet-strength agent or another strength-enhancing agent is added to the web before the step of pressing.

17. The method according to claim 1, wherein the web is a tissue web or a nonwoven web.

18. The method according to claim 1, wherein the step of exerting includes exerting upon the web in the at least one high-pressure zone a pressure of more than 10 MPa.

19. A web of fibrous material, the web comprising:
at least one low-pressure zone; and
at least one high-pressure zone, which is configured such that, in the at least one high-pressure zone, a pressure of more than 10 MPa is exerted upon the web,
the web being configured for being formed by a method which includes the steps of:
forming the web by a dry-laying process;
pressing and consolidating the web in a press nip while the web lies between a first support element and a second support element, a contact surface of the first support element and a contact surface of the second support element respectively facing the web, the contact surface of the second support element being smooth;
forming the at least one low-pressure zone and the at least one high-pressure zone in the web by way of the contact surface of the first support element; and exerting upon the web in the at least one high-pressure zone a pressure of more than 10 MPa.

* * * * *